US007992755B2

(12) United States Patent
Kameda

(10) Patent No.: US 7,992,755 B2
(45) Date of Patent: Aug. 9, 2011

(54) STAPLE FEEDING MECHANISM IN STAPLER

(75) Inventor: Futoshi Kameda, Tokyo (JP)

(73) Assignee: Max Co., Ltd., Tokyo (JP)

( * ) Notice: Subject to any disclaimer, the term of this patent is extended or adjusted under 35 U.S.C. 154(b) by 233 days.

(21) Appl. No.: 12/424,818

(22) Filed: Apr. 16, 2009

(65) Prior Publication Data

US 2009/0266865 A1 Oct. 29, 2009

(30) Foreign Application Priority Data

Apr. 25, 2008 (JP) ..... P 2008-115367

(51) Int. Cl.
*B27F 7/21* (2006.01)

(52) U.S. Cl. ..... 227/131; 227/120

(58) Field of Classification Search ..... 227/119, 227/120, 131, 154, 134, 138
See application file for complete search history.

(56) References Cited

U.S. PATENT DOCUMENTS

| | | | | |
|---|---|---|---|---|
| 3,009,618 | A * | 11/1961 | Lerner | 226/162 |
| 4,588,121 | A * | 5/1986 | Olesen | 227/120 |
| 5,273,199 | A * | 12/1993 | Logtens | 227/87 |
| 5,346,114 | A * | 9/1994 | Udagawa et al. | 227/120 |
| 5,560,529 | A * | 10/1996 | Udagawa et al. | 227/136 |
| 6,039,230 | A * | 3/2000 | Yagi et al. | 227/120 |
| 6,371,351 | B1 * | 4/2002 | Magnusson | 227/119 |
| 6,705,504 | B1 * | 3/2004 | Kanai et al. | 227/135 |
| 6,899,258 | B2 * | 5/2005 | Haramiishi | 227/2 |
| 6,918,527 | B2 * | 7/2005 | Hakozaki et al. | 227/131 |
| 7,017,789 | B2 * | 3/2006 | Mochizuki et al. | 227/119 |
| 7,143,921 | B2 * | 12/2006 | Hakozaki et al. | 227/120 |
| 7,377,414 | B2 * | 5/2008 | Kishi et al. | 227/120 |
| 2002/0040919 | A1 | 4/2002 | Magnusson | |

FOREIGN PATENT DOCUMENTS

| | | |
|---|---|---|
| EP | 0 845 338 A1 | 6/1998 |
| EP | 1 066 934 A2 | 1/2001 |
| EP | 1 779 978 | 5/2007 |
| JP | 6-63343 | 9/1994 |

* cited by examiner

*Primary Examiner* — Scott A. Smith
(74) *Attorney, Agent, or Firm* — Drinker Biddle & Reath LLP

(57) ABSTRACT

A staple feeding mechanism includes the components of only a magazine with a pair of guides and spring receiver being integrated, a driving shaft having a double function and a staple feeding member (inclusive of the feeding nail and spring) movably arranged in the magazine. The feeding nail of the staple feeding member at the home position is lowered by the driving shaft and retracted from the staple cartridge. For this reason, the loading/unloading of the staple cartridge can be done without any hitch. The staple feeding mechanism only requires a necessary minimized number of components and so is simple in structure. Thus, the stapler can be provided at low cost. Particularly, the driving shaft necessary to cause the magazine to make a reciprocating motion is also used as a fulcrum member, thus requiring no new component. This further reduces the number of necessary components and also contributes to space saving.

2 Claims, 14 Drawing Sheets

STAPLE FEEDING MECHANISM IN STAPLER

FIELD OF THE INVENTION

The present disclosure relates to a staple feeding mechanism for feeding a staple in a staple cartridge to a driving path.

DESCRIPTION OF RELATED ART

In a related-art, there are various feeding mechanisms for feeding a staple in a feeding direction using a roller or feeding nail. For example, Japanese Utility Model Application Publication No. JP-UM-A-6-63343 discloses a mechanism for feeding a staple by a plate which is slid using a reciprocating motion of a magazine.

Where a system of arranging the above feeding nail on the side of a stapler body (hereinafter also simply referred to as a "body") is adopted in a type of stapler provided with a magazine making a reciprocating motion for the body and with a staple cartridge (hereinafter also simply referred to as a cartridge) loaded in the magazine removably arranged, it is supposed to forcibly retract the feeding nail from the cartridge in taking out the cartridge from the magazine (i.e. when the cartridge is located at a "home position"). Specifically, a component for retracting the feeding nail at the home position in synchronism with the reciprocating motion of the magazine (e.g. component such as a retracting spring or a cam mechanism) is required. This will lead to an increase in the number of components and cost increase.

SUMMARY OF INVENTION

Illustrative aspects of the present invention provide a staple feeding mechanism in a simple and inexpensive stapler.

According to a first aspect of the invention, a staple feeding mechanism in a stapler is provided with a driving mechanism, a staple feeding member arranged in the driver unit or the clincher unit moving for the stapler body, and the staple feeding member including a feeding piece feeding the staples toward a driving path of the staple cartridge, a guide member arranged in the driver unit or the clincher unit, and a fulcrum member arranged in said stapler body in a positioned state. The driving mechanism reciprocates at least one of a driver unit and a clincher unit from a home position before a binding operation to the same home position through a clinch completing position where clinching legs of a staple. The driver unit forms a pair of legs for each bar-like staple and drives the formed C-shaped staple by a driver. The clincher unit is opposite to the driver and includes a clincher bending the legs of the staple, thereby binding sheets. The guide member guides a feeding operation of the staple feeding member. The fulcrum member causes the staple feeding member to make the feeding operation in a positional relationship therewith as the driver unit or the clincher unit moves. At the home position, the feeding piece is retracted from the staple cartridge by the fulcrum member and the guide member. Before the driver unit or the clincher unit drives out the C-shaped staple, the staple feeding member completes the feeding operation of the staple.

Now, the fulcrum member arranged in the stapler body in its positioned state may be for example, a frame arranged in the stapler body, a separate component arranged on the frame or a driving shaft for fixing a driving gear. Further, the state where the fulcrum member is positioned for the stapler body means that the position of the fulcrum member arranged in the stapler body is determined; as long as the fulcrum member is positioned, the fulcrum member itself may make any motion such as rotation like the driving shaft. Namely, the fulcrum member may be any component as long as it can cause the staple feeding member to make a feeding operation in a relative positional relationship therewith as the driver unit or the clincher unit moves.

DETAILED DESCRIPTION OF EXEMPLARY EMBODIMENTS

Now, referring to FIGS. 1 to 8, an explanation will be given of a staple feeding mechanism in a stapler which is an embodiment of the present invention. In the embodiment, it is assumed that the stapler is an electric type in which staples wound in a roll shape are housed in a staple cartridge. Further, it is assumed that this electric stapler (hereinafter also simply referred to as a stapler) is incorporated in e.g. a copier or facsimile to automatically bind a threshold number of sheets to be copied or fax-received.

Figure 1:
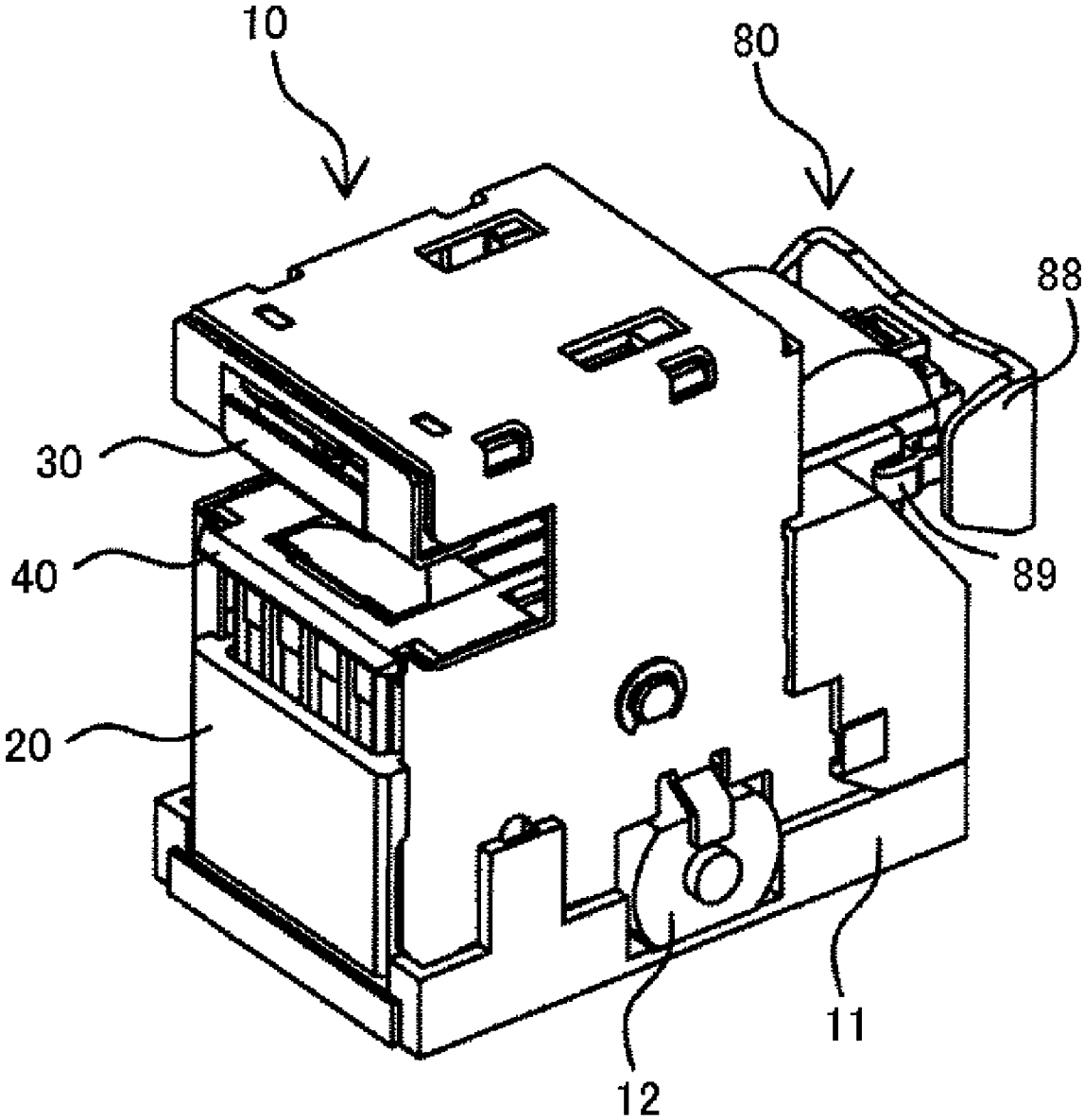
FIG. 1 is a perspective view of an entire stapler according to an embodiment of the present invention.
Figure 2:
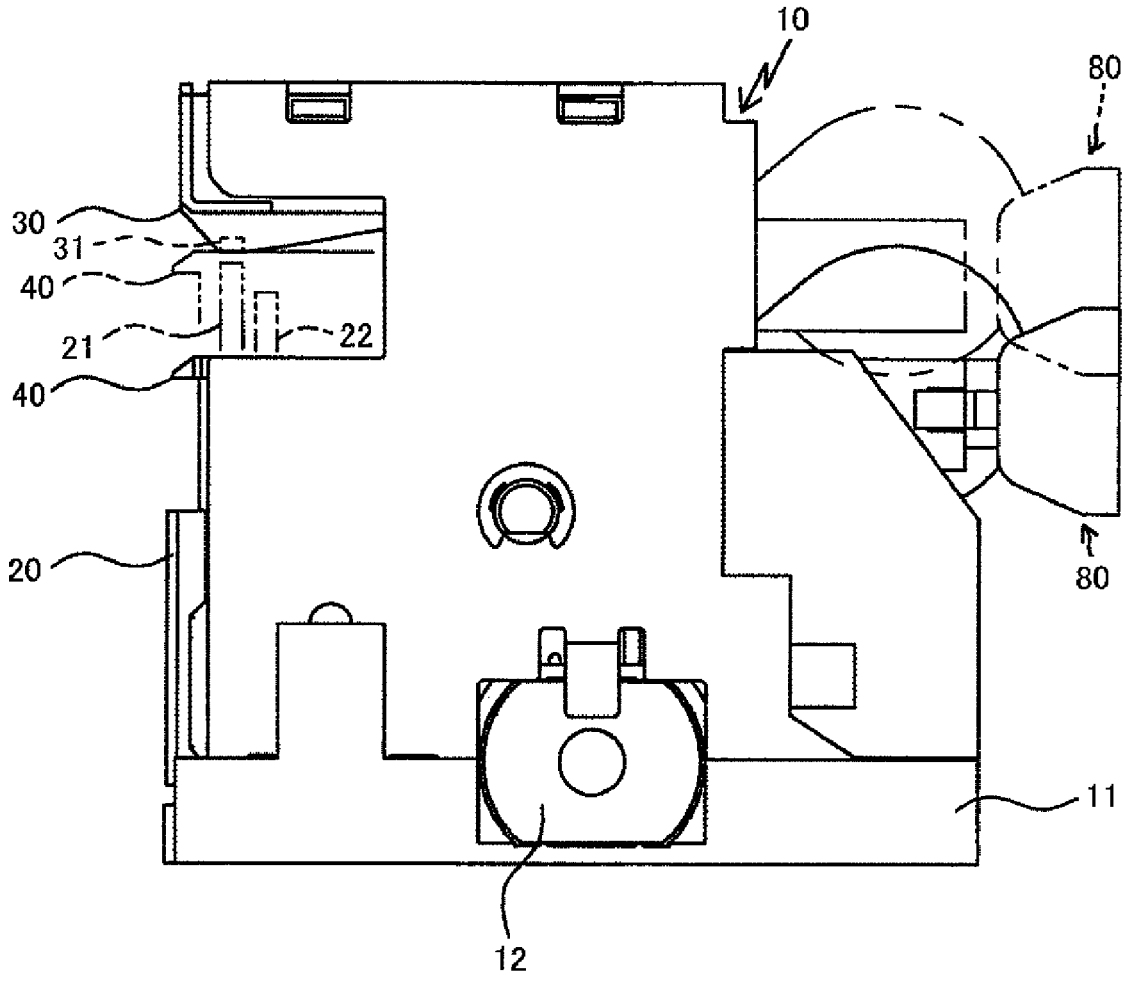
FIG. 2 is a side view of the stapler shown in FIG. 1.
Figure 3:
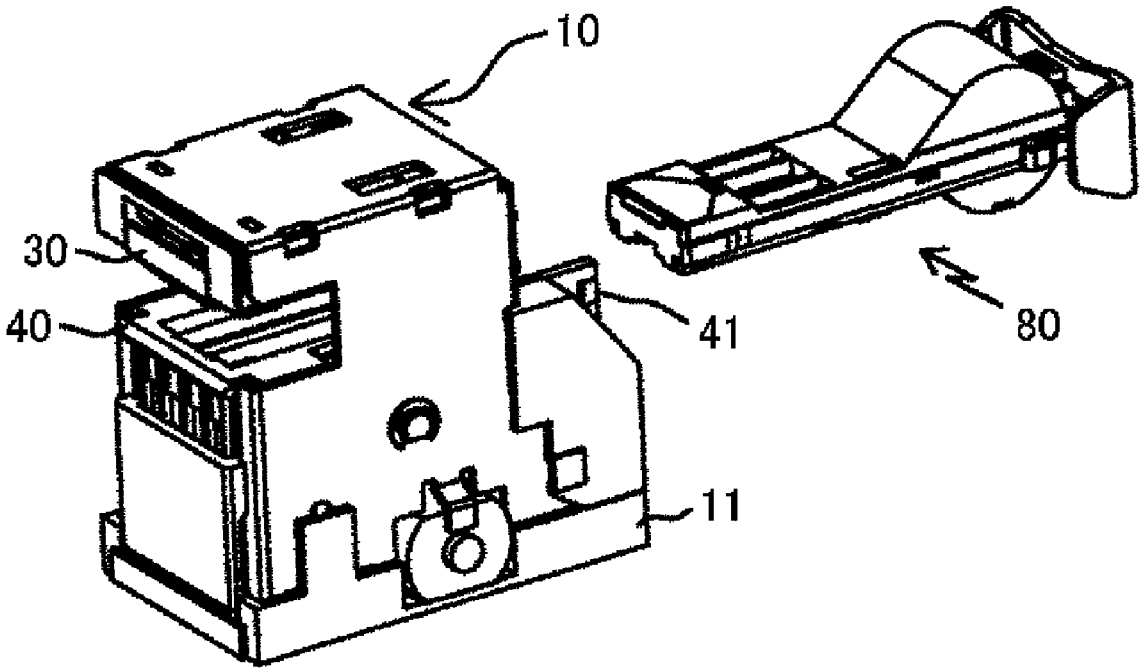
FIG. 3 is a perspective view when a staple cartridge has been removed from a stapler body shown in FIG. 1.
Figure 4:
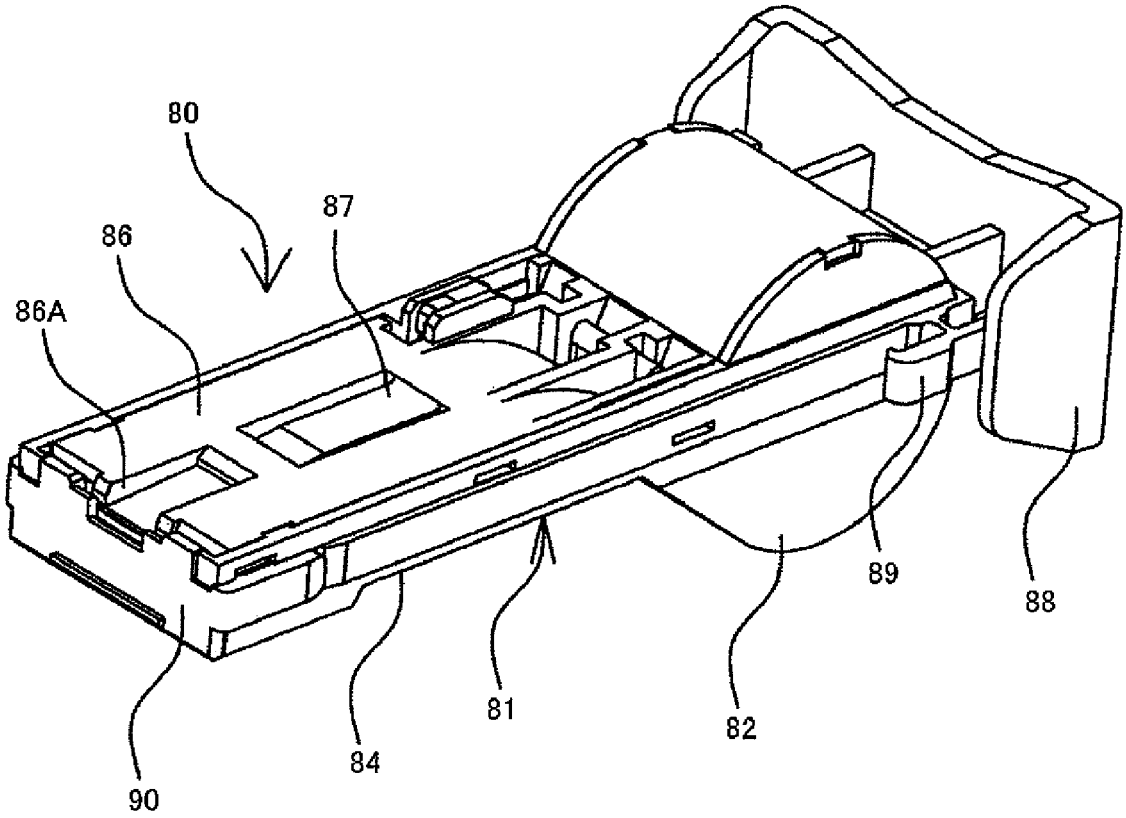
FIG. 4 is a perspective view of the entire staple cartridge shown in FIG. 3.
Figure 5:
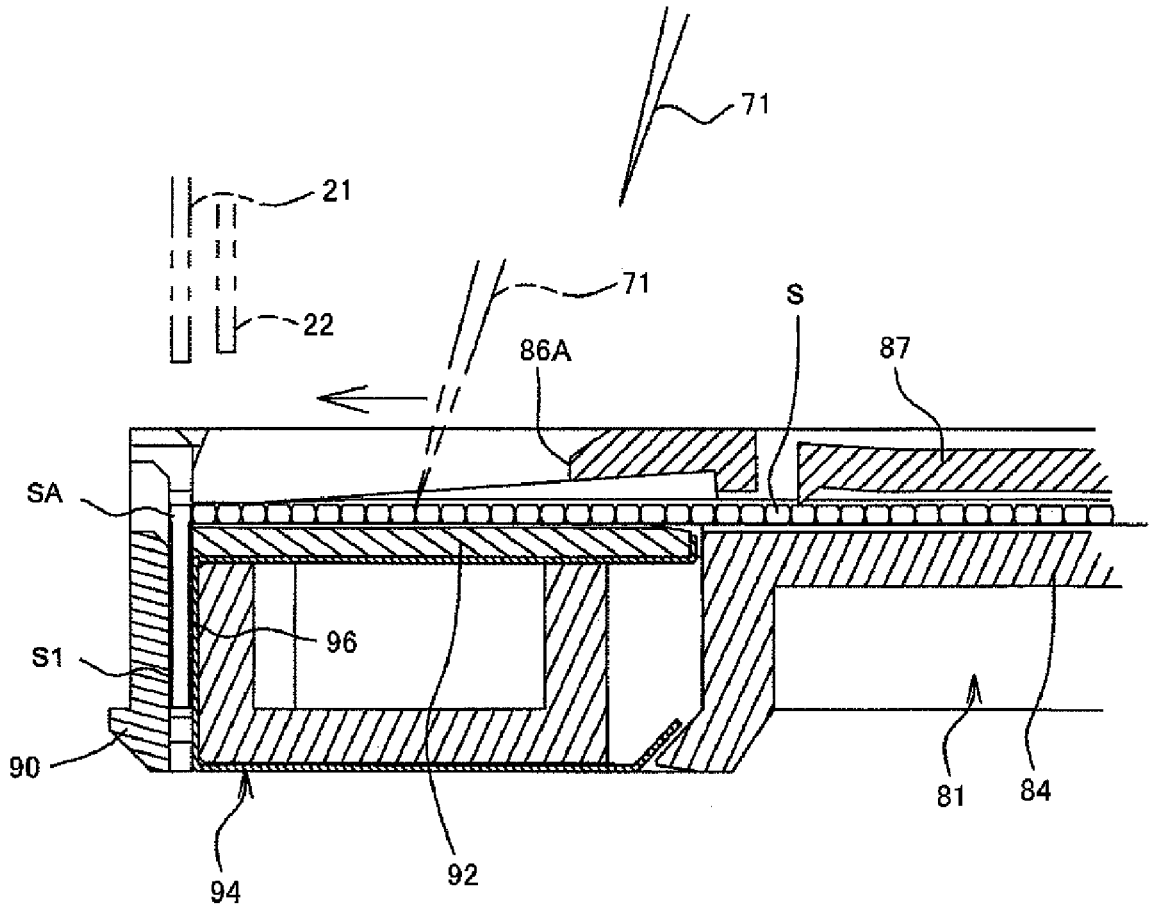
FIG. 5 is an enlarged sectional view of the main part of the stapler cartridge shown in FIG. 4.
Figure 6:
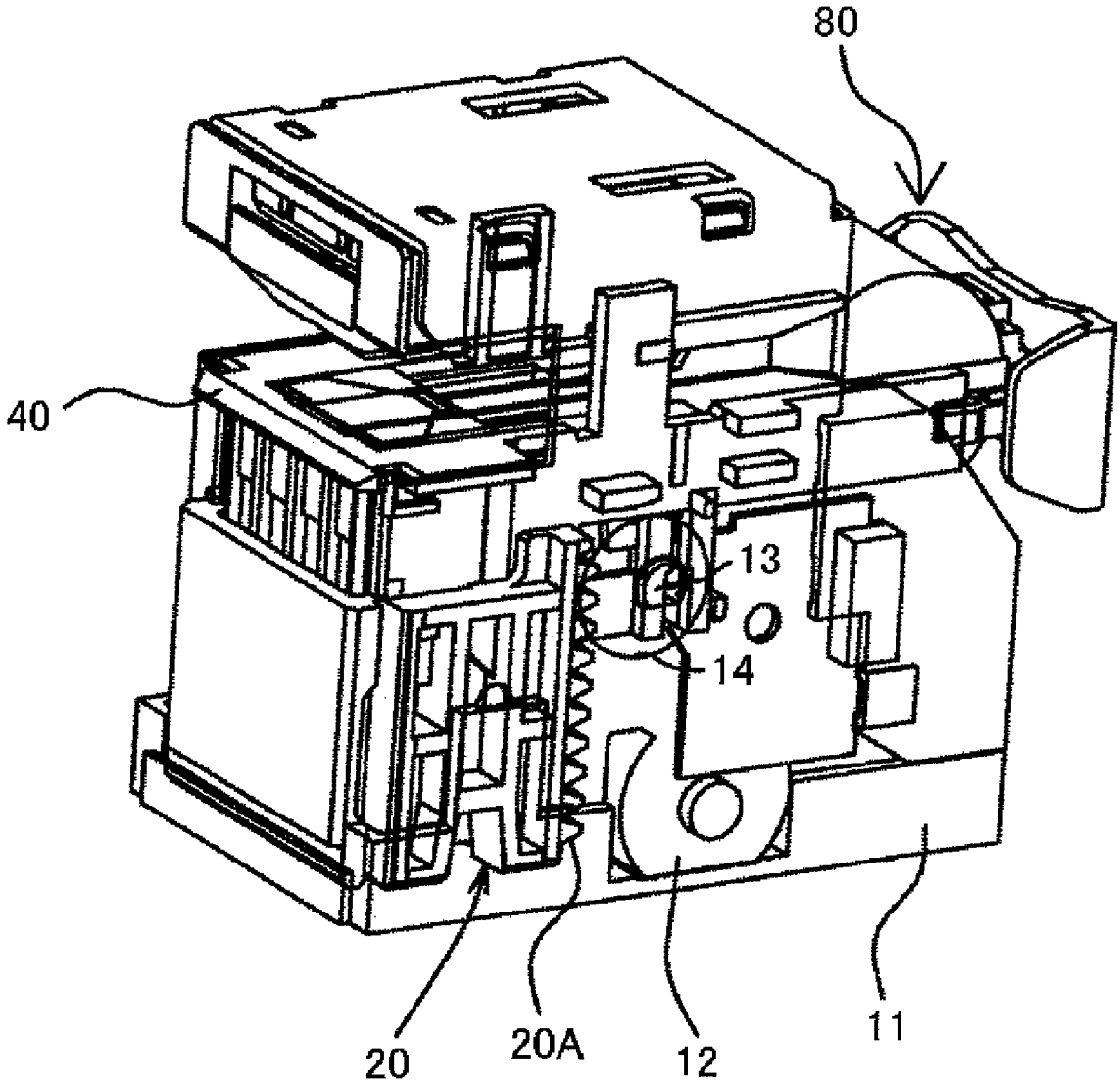
FIG. 6 is a schematic view of a magazine driving mechanism shown in FIG. 1.
Figure 7:
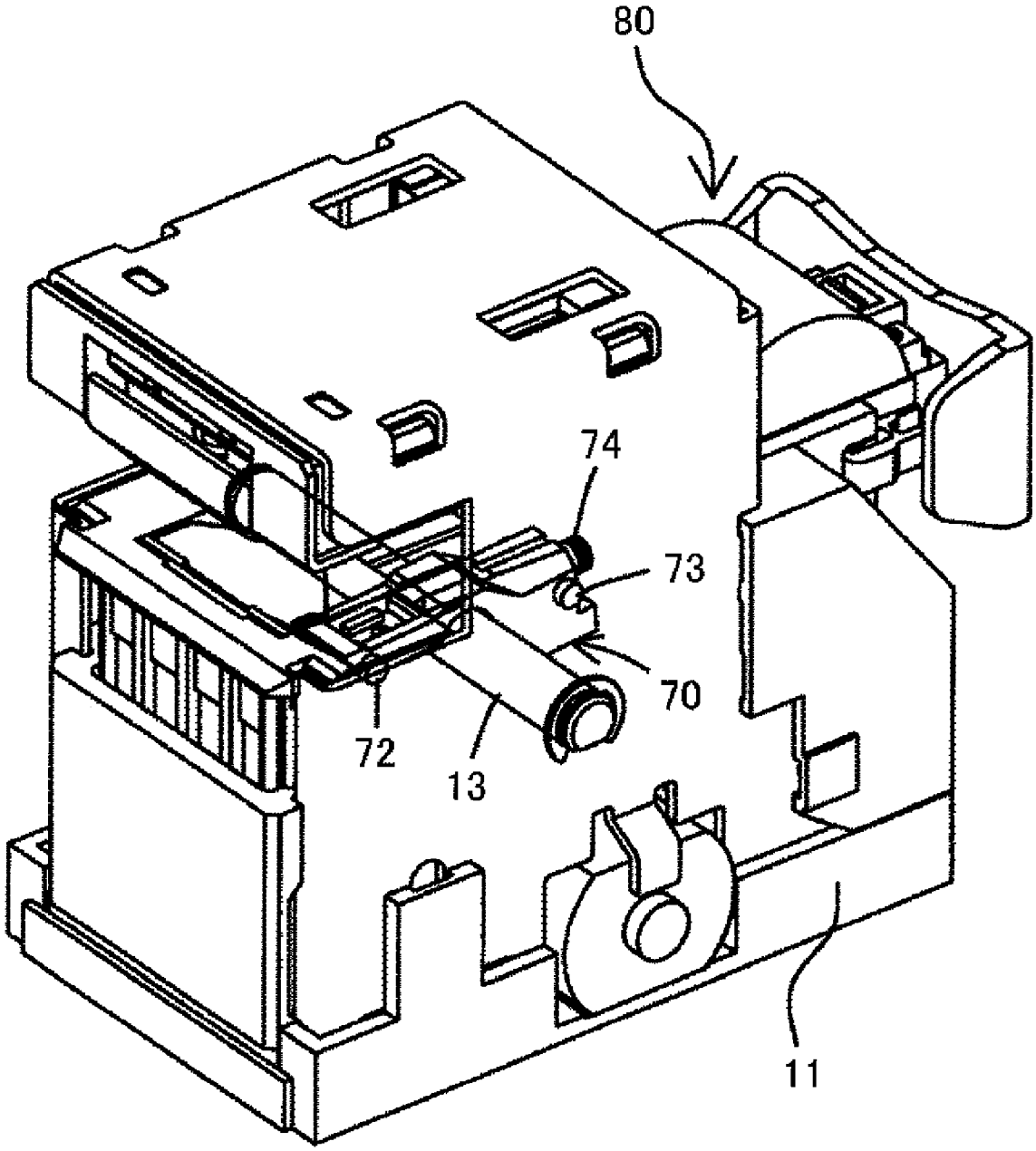
FIG. 7 is a schematic view of a staple feeding mechanism shown in FIG. 6.
Figure 8:
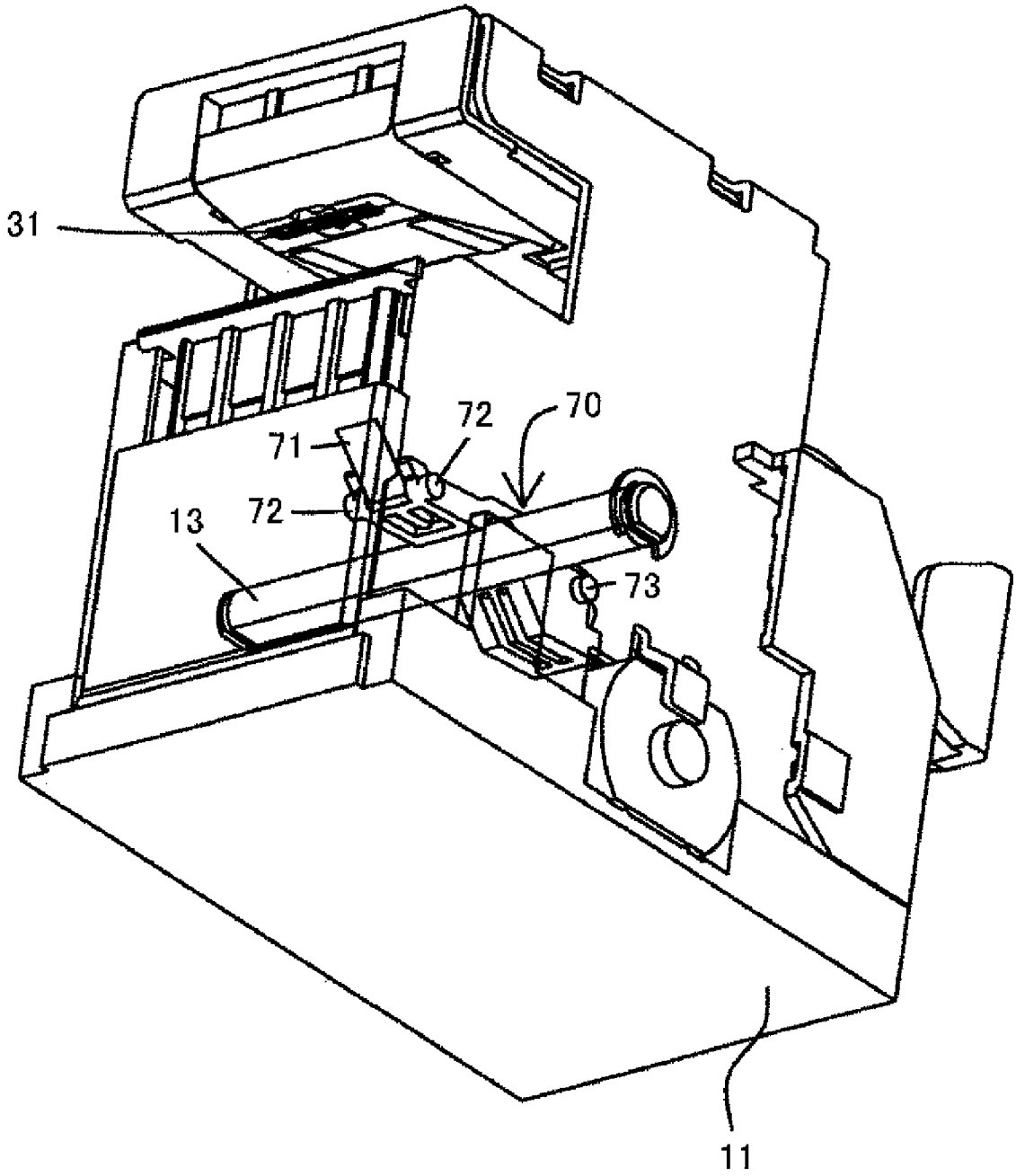
FIG. 8 is a schematic view of the staple feeding mechanism shown in FIG. 7 when viewed from a different angle.

The stapler is adapted to be capable of removing the staple cartridge. FIG. 1 is a perspective view of an entire stapler according to the embodiment. FIG. 2 is a side view of the stapler shown in FIG. 1. FIG. 3 is a perspective view when a staple cartridge has been removed from a stapler body shown in FIG. 1. FIG. 4 is a perspective view of the entire staple cartridge shown in FIG. 3. FIG. 5 is an enlarged sectional view of the main part of the stapler cartridge shown in FIG. 4. FIG. 6 is a schematic view of a magazine driving mechanism shown in FIG. 1. FIG. 7 is a schematic view of a staple feeding mechanism shown in FIG. 6. FIG. 8 is a schematic view of the staple feeding mechanism shown in FIG. 7 when viewed from a different angle.

As shown in FIGS. 1 to 3, a stapler 10 includes a stapler body 11 constituting a frame. Further, the stapler 10 includes a reversible electric motor (hereinafter simply referred to as a motor) 12; a driver link (which is identical to a driver unit) 20; a driver 21 and forming plate 22, indicated in two-dot chain line in FIG. 2; a table 30; and a magazine 40.

The magazine 40 serves to load a staple cartridge 80 therein. The magazine 40 is held apart from the driver link 20 through a spring not shown. The magazine 40 and driver link 20 makes a single reciprocating motion in a vertical direction by the motor 12 serving as a driving source (see two-dot chain line in FIG. 2). The motor 12 is fixed to the stapler body 11 constructed of a base frame or the like.

The driver link 21 and forming plate 22 are fixed to the driver link 20 shown in FIG. 2. The forming plate 22 which is a forming means is a plate for forming a bar-like staple S before shaped (see FIG. 5) into a C-shape (i.e. forming legs S1 of the staple S). The driver 21 is a plate for driving a staple SA located at the foremost end (identical to a driving path) into driven bound sheets (not shown).

The table 30 is always urged toward the magazine 40 through a spring not shown. On the table 30, as indicated by the two-dot chain line in FIG. 2, a clincher 31 (see FIG. 8) is arranged oppositely to the driver 21. The clincher 31 is a stand for bending the legs S1 of the staple S driven by the driver 21 (see FIG. 5). The table 30 constitutes a "clincher unit".

As shown in FIG. 4, the staple cartridge 80 includes a cartridge body 81 made of synthetic resin, a face plate 90 made of metal, a staple guide 92 made of metal and a pusher 94 made of metal, as shown in FIG. 5. The cartridge 81 includes a housing segment 82, a deriving segment 84, a cover 86 and a knob 88. The knob 88 is located at the rearmost end of the cartridge 81, and formed in a C-shape in the planar shape so that it can be grasped when the cartridge 80 is unloaded from or loaded in the magazine 40. FIG. 4 is a perspective view when viewed from the opposite side of FIG. 3.

The housing segment 82 is formed in a cylindrical shape on the front side of the knob 88, in which a belt of staples S is housed. The deriving segment 84 is formed in a C-shape in section to continue from near the center of the housing segment 82. The staples S housed in the housing segment 82 are successively fed to the driving path shown in FIG. 5 via the deriving segment 84 by a feeding nail (identical to a "feeding piece") 71 of a staple feeding member 70 (see FIGS. 7 and 8) described later.

The cover 86 is formed in a plate shape to cover the deriving segment 84. At near the center of the cover 86, a retaining piece 87 is integrally formed. The retaining piece 87, as shown in FIG. 5, serves to retain and position the staples S fed successively onto the feeding side of the deriving segment 84 and prevent the reverse motion of the staples S within the deriving segment 84. Further, on the feeding side of the cover 86 (identical to the front side), a rectangular opening 86A is formed. The metallic feeding nail 71 is passed through the opening 86A to feed each staple S to the foremost end.

The face plate 90, as shown in FIG. 5, covers the foremost end of the cartridge body 81 to form the driving path of a staple SA. Further, as shown in FIG. 4, the cartridge body 81 is integrally provided with a pair of fastening pieces 89 on the knob 88 side. The fastening piece 89 is fastened to a stopper 41 (see FIG. 3) formed on the magazine 40 so that the staple cartridge 80 is loaded in the magazine 40. Further, the staples S in the embodiment are bar-like before the staples S are formed into the C-shape; the plurality of staples S are successive using e.g. a tape not shown (see FIG. 5).

The staple guide 92 is formed in a planar plate shape and serves as a receiving stand when the bar-like before-formed staple S shown in FIG. 5 is bent in a C-shape by the forming plate 22 to form the legs S1. The pusher 94 is integrally provided with a pair of spring pieces 96 formed so as to correspond to the legs S1 of the staple SA. The spring pieces 96 urge the legs S1 of the staple SA toward the face plate 90 so that the legs S1 are located on the same line (identical to vertical) as the driver 21.

Referring to FIG. 6, the driving mechanism of the magazine 40 will be explained. The driver link 20 is provided with a pair of racks 20A formed along an ascending/descending direction. On the other hand, on the stapler body 11, a driving shaft 13 serving as a fulcrum is rotatably pivoted. A driving gear (identical to a pinion) 14 is arranged on the driving shaft 13 which is cylindrical so as to correspond to the rack 20A. The driving gear 14 is supplied with the rotating force from the motor 12 shown in FIG. 1 through a rotating force transmitting mechanism (not shown).

The driver link 20 (inclusive of the magazine 40 and staple cartridge 80) makes, for the stapler body 11, a single reciprocating motion from the home position shown in FIG. 6 to the same home position via a clinch completing position (i.e. the position slightly ascended from the position of the two-dot chain line in FIG. 2). Specifically, when a sheet-binding signal is supplied to the control unit (not shown) of the stapler 10 from e.g. a facsimile device, the control unit causes the driver link 20 to ascend/descend so that the sheet binding operation of sheets to be bound (not shown) is carried out.

Figure 10:
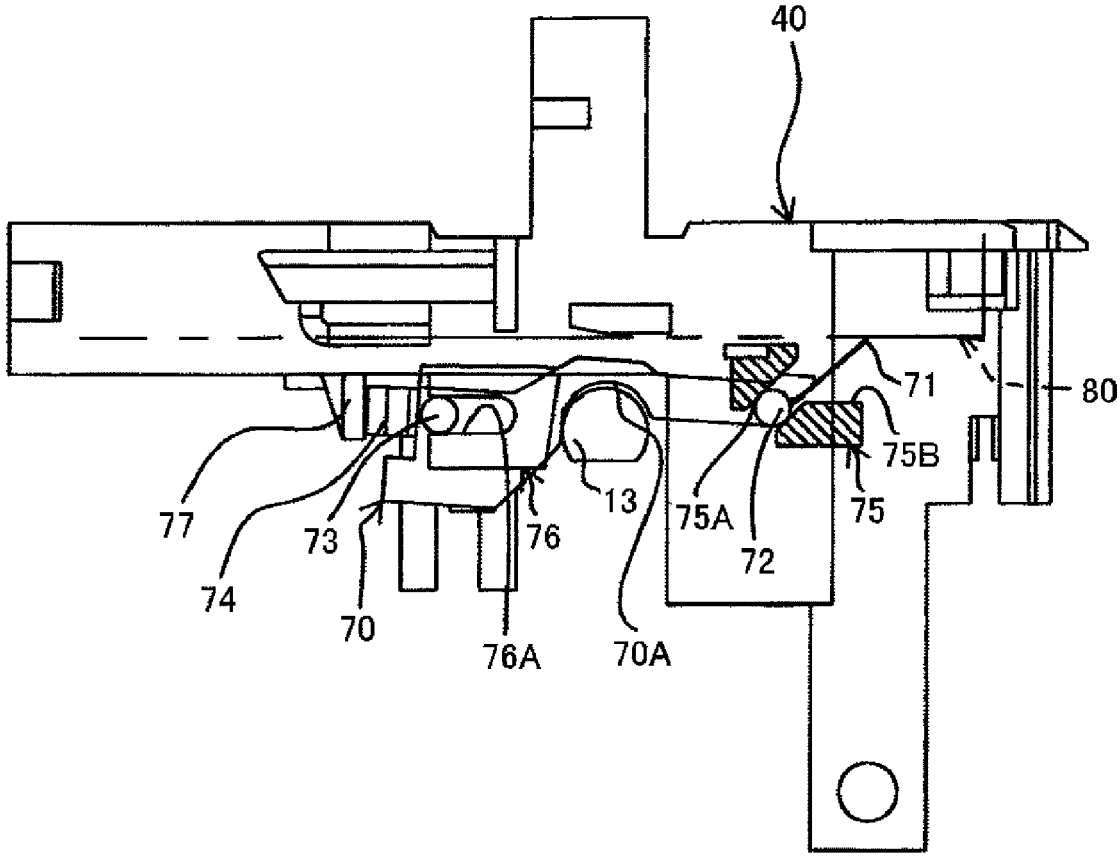
FIG. 10 is a schematic view of the main part of the staple feeding mechanism shown in FIG. 9.

The staple feeding mechanism, as shown in FIG. 10, includes the above driving shaft 13, a staple feeding member 70, a spring 74, a pair of guides 75, 76, and a spring receiver 77. The staple feeding member 70 shown in FIGS. 7 and 8 is movably arranged on the magazine 40 (see FIG. 10) which ascends/descends for the stapler body 11. As shown in FIG. 8, the plate-like feeding nail 71 is arranged at the tip of he staple feeding member 70.

Figure 9:
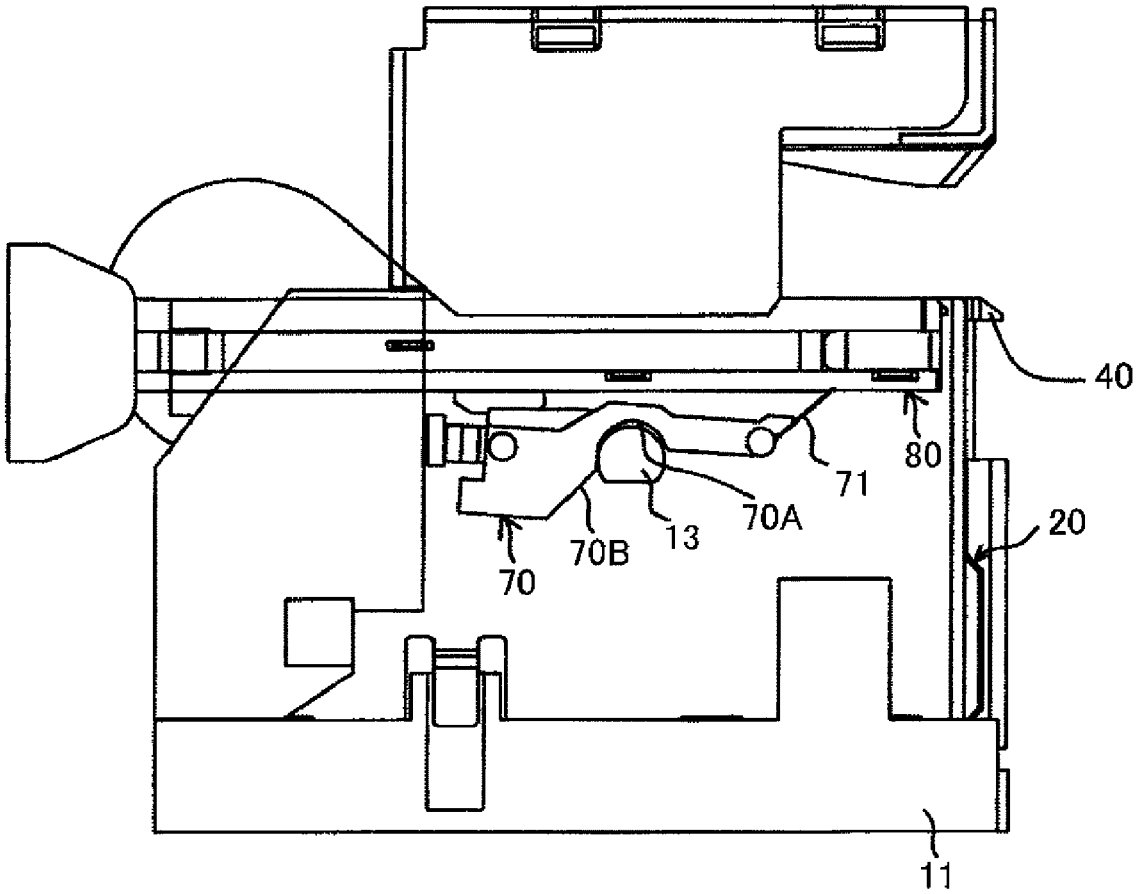
FIG. 9 is a schematic view of a staple feeding mechanism at a home position indicated in FIG. 8.

The staple feeding member 70 is provided with a pair of pins 72 projected at the front end and also a pair of pins 73 provided at the rear end. Further, as shown in FIG. 9, at the center of the staple feeding member 70, a bearing 70A is notched in an arc shape, and a slanting slope 70B is formed continuously to the bearing 70A. With the driving shaft 13 fit in the bearing 70A, the staple feeding member 70 performs the feeding operation in a relative positional relationship between the driving shaft 13 positioned on the stapler body 11 and the staple feeding member 70 arranged in the magazine 40 ascending/descending (see FIGS. 9 to 14).

As shown in FIG. 10, at the rear end of the staple feeding member 70, the spring 74 is wound (see FIG. 7). A spring receiver 77 is formed integrally with the magazine 40 so as to correspond to the spring 74. As shown in FIG. 10, the spring 74 always urges the staple feeding member 70 toward the feeding direction.

The guide 75 is formed integrally with the magazine 40 so as to correspond to the pin 72 of the staple feeding member 70. The guide 75 has a slanting guide groove 75A extending upward and a horizontal plane 75B continuous to the guide groove 75A. Along the guide groove 75A and horizontal plane 75B, the pin 72 is guided. In this way, the staple feeding member 70 performs the above feeding operation.

The guide 76 is formed integrally with the magazine 40 so as to correspond to the pin 73 of the staple feeding member 70. The guide 76 has a horizontal guide groove 76A. Along this guide groove 76, the pin 73 is guided in the horizontal directions. In this way, the staple feeding member 70 performs the above feeding operation. The guide groove 76A has a stopper function of stopping the pin 73 at a threshold position.

The reason why the guide groove 75A is slanting is to permit the feeding nail 71 of the staple feeding member 70 to leave the staple cartridge 80 in the magazine 40 (inclusive of the staple feeding member 70) at the home position. Further, as the staple feeding member 70 is guided along the guide grooves 75A and 75B, the feeding nail 71 is caused to ascend and thereafter slide in the horizontal direction.

The slope 70B of the staple feeding member 70 has an inclining angle approximately equal to that of the guide groove 75A. In the manner that the pin 72 of the staple feeding member 70 and driving shaft 13 are guided by the guide groove 75A of the guide 75 and the slope 70B of the staple feeding member 70, the feeding nail 71 is caused to perform the feeding operation. Since the guides 75 and 76 and the spring receiver 77 are integrated to the magazine 40 which ascends/descends together with the driver link 20, no new member is required to guide the staple feeding member 70.

An operation of the embodiment will be explained.

The sheet binding processing in the stapler 10 is carried out as follows. When the above sheet binding signal is supplied to the control unit not shown, the motor 12 is normally driven. Thus, the rotary motion of the driving shaft 13 and others shown in FIG. 6 is converted into the linear motion so that the driver link 20 (inclusive of the magazine 40 and staple cartridge 80) is caused to ascend.

Referring to FIGS. 9 to 14, an explanation will be given of the feeding operation of the staple feeding mechanism. The feeding operation is done when the driver link 20 (inclusive of the magazine 40 and staple feeding member 70) ascends from its home position (i.e. stand-by position indicated in FIGS. 6 and 10) to a position before clamping of the sheets to be bound (not shown) is completed (slightly lower than the position of two-dot chain line in FIG. 2). FIGS. 9 to 14 are side views on the side opposite to the side view of the stapler 10 shown in FIG. 2. The position indicated in FIG. 10 is an initial position of the staple feeding member 70.

As shown in FIG. 9, at the home position, the feeding nail 71 of the staple feeding member 70 is lowered by the driving shaft 13 and others and retracted from the staple cartridge 80 (see FIG. 5). Namely, as shown in FIG. 10, the bearing 70A of the staple feeding member 70 is fit in the driving shaft 13 and the pin 72 thereof is stopping at the base end of the guide groove 75A.

More specifically, in the staple feeding member 70 urged by the spring 74, a vector oriented forward in an obliquely downward direction acts on the pin 72 and guide 75 corresponding to the pin 72 at a fulcrum of the driving shaft 13. So, the feeding nail 71 is held in the state retracted from the staple cartridge 80. The centers of the pins 72 and 73 are located on the same horizontal line as shown in FIG. 10 so that the staple feeding member 70 is held in a "forward-bent posture".

Figure 11:
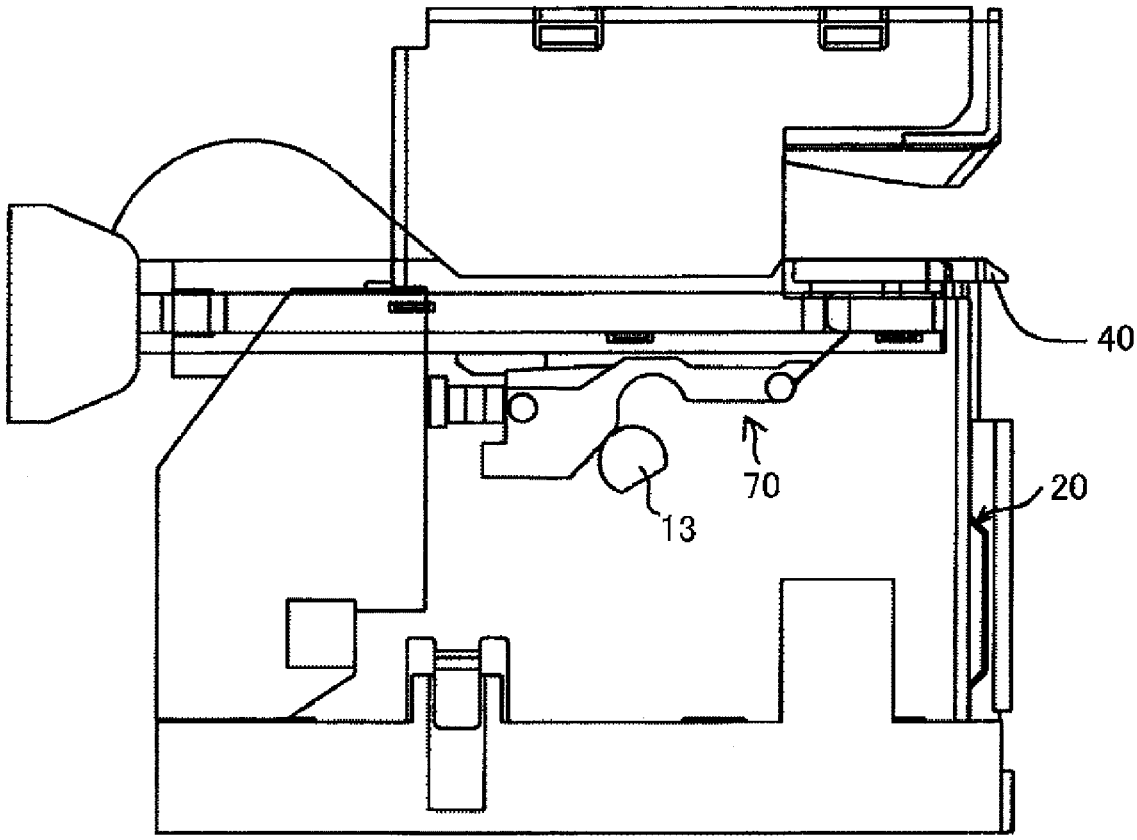
FIG. 11 is a schematic view of the state when the staple feeding mechanism shown in FIG. 9 starts a feeding operation.
Figure 12:
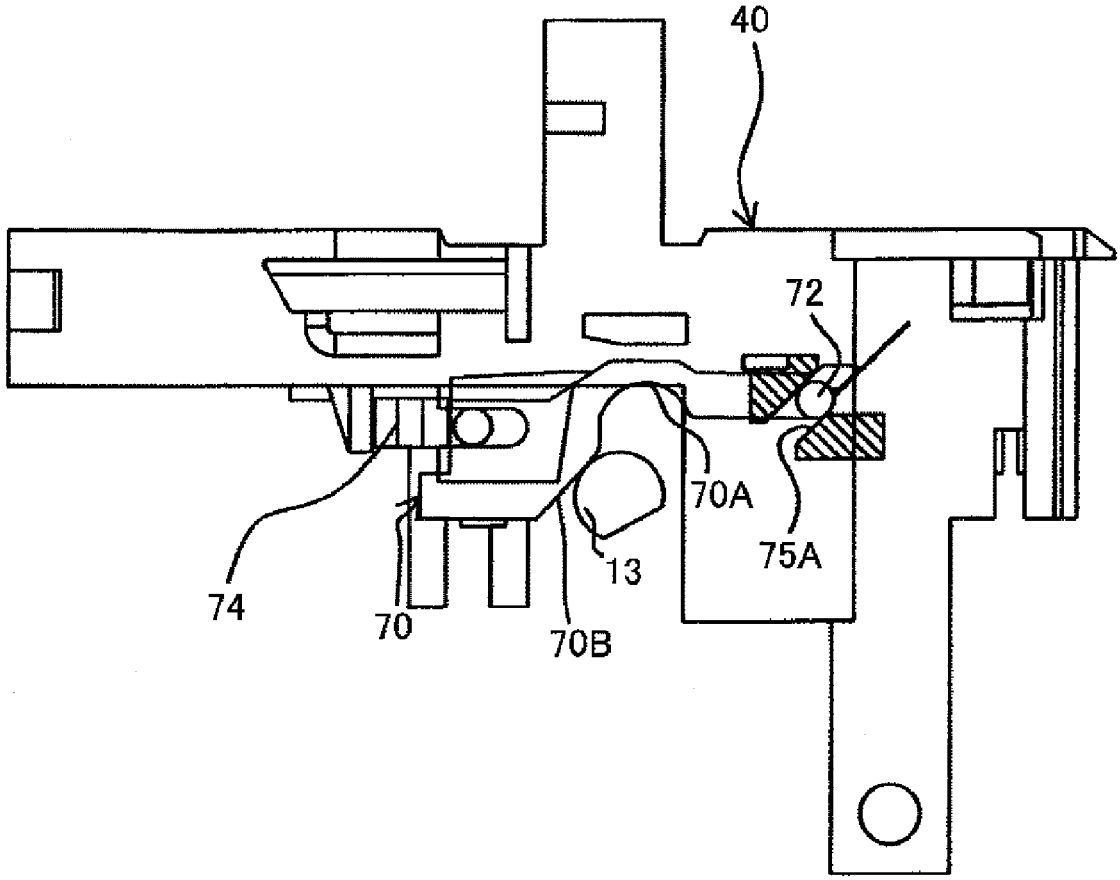
FIG. 12 is a schematic view of the main part of the staple feeding mechanism shown in FIG. 11.

When the driver link 20 ascends to the clinch completing position, as shown in FIG. 11, the staple feeding member 70 rotates at a fulcrum of the driving shaft 13 on the basis of the relative positional relationship between the magazine 40 and the driving shaft 13. Specifically, when the magazine 40 ascends to leave the driving shaft 13, as shown in FIG. 12, in the staple feeding member 70 whose bearing 70A comes out from the driving shaft 13, its slope 70B ascends while keeping in contact with the driving shaft 13.

Owing to the urging force of the spring 74, the staple feeding member 70 is moved in the feeding direction while getting up along the guide groove 75A. Namely, as shown in FIG. 12, since the center of the pin 72 and the center of the pin 73 are displaced by nearly one pin on the horizontal line so that the staple feeding member 70 becomes the got-up state.

Figure 13:
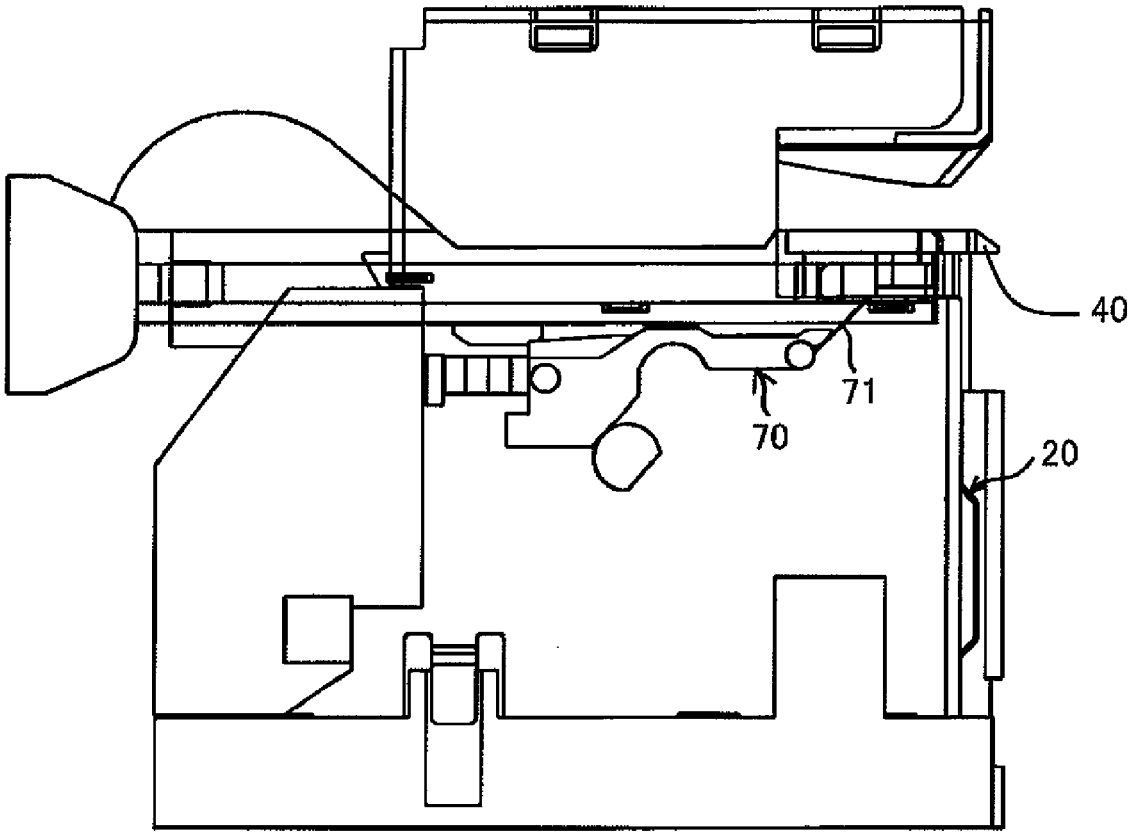
FIG. 13 is a schematic view of the state when the staple feeding mechanism shown in FIG. 11 completes a feeding operation.

Successively, when the driver link 20 further ascends, as shown in FIG. 13, the feeding nail 71 of the staple feeding member 70 is brought into contact with the staple S shown in FIG. 5 (see two-dot chain line in FIG. 5) and slides in the feeding direction over a threshold distance. By this sliding, the feeding nail 71 shown in FIG. 5 enters the gap between the staples S thereby to advance the staple S towards the driving path.

Figure 14:
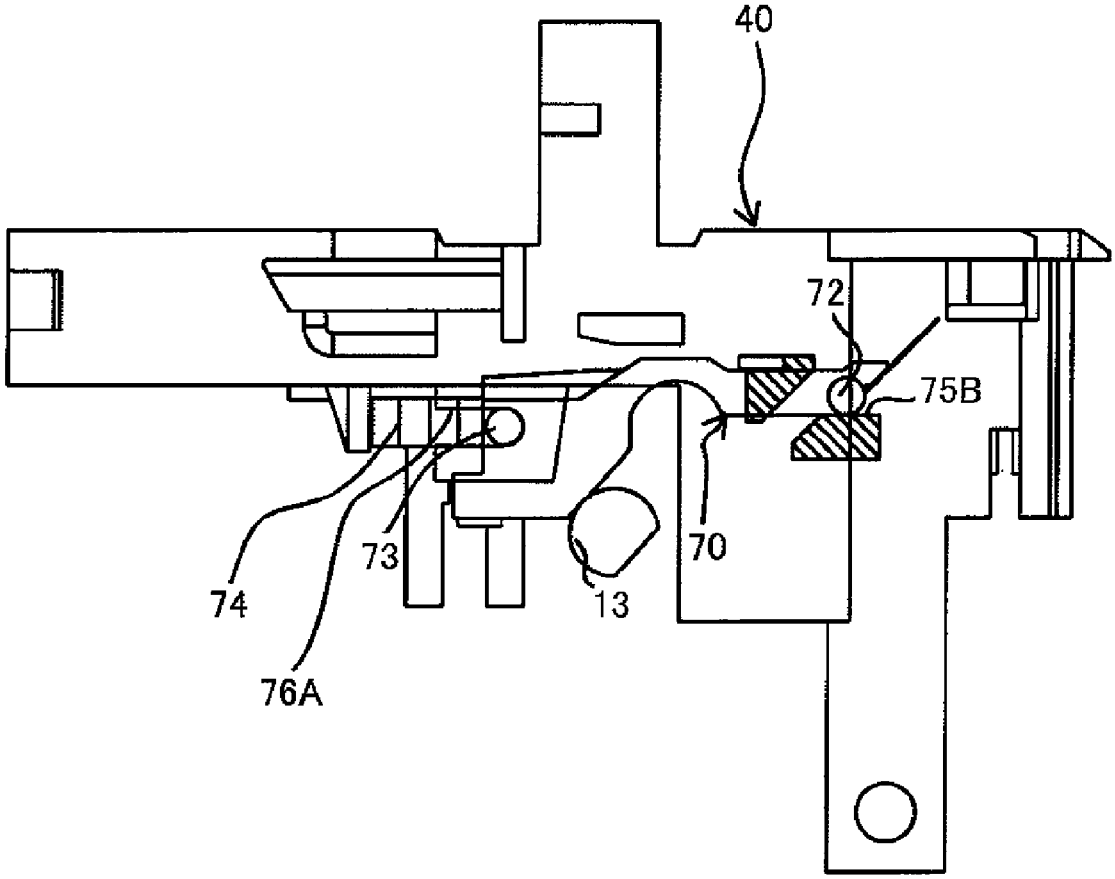
FIG. 14 is a schematic view of the main part of the staple feeding mechanism shown in FIG. 13.

Specifically, when the magazine 40 ascends to leave the driving shaft 13, as shown in FIG. 14, owing to the urging force of the spring 74, the staple feeding member 70 slides along the horizontal plane 75B in the feeding direction. The staple feeding member 70 stops its sliding when the pin 73 comes in the end edge of the guide groove 76A. In the embodiment, before the staple S with its legs formed is driven by the driver 21 (see FIG. 2), the staple feeding member 70 has completed the feeding of the belt-like staples S shown in FIG. 5. Therefore, in driving by the driver 21, the staple SA is surely hit against the face plate 90 side to be situated on the driving path.

After the magazine 40 ascends to a supposed line in FIG. 2 to clamp the sheets (not shown), the staple SA with the legs formed situated on the driving path is driven out toward the sheets to be bound by the driver 21 shown in FIG. 5. When the magazine 40 is further caused to ascend to the clinch completing position, the legs S1 of the staple SA passing through the bound sheets are bent by the clincher 31 (see FIGS. 2 and 8) arranged oppositely to the driver 21, thus completing the clinch.

Upon completion of the clinch, the motor 12 is driven reversely so that the driver link 20 is restored to the home position shown in FIGS. 6 and 10. When the driver link 20 descends, the staple feeding member 70 is also restored to the initial position by the reverse operation of the above feeding operation. Namely, in the embodiment, the driving source of the staple feeding member 70 is set in the relative positional relationship between the staple feeding member 70 arranged on the magazine 40 ascending/descending and the driving shaft 13 driving the driver link 20. Therefore, the cam mechanism or linkage mechanism for driving the staple feeding member 70 is not required.

Further, in the embodiment, the feeding nail 71 of the staple feeding member 70 at the home position is in a state retracted from the staple cartridge 80. For this reason, the loading/unloading of the staple cartridge 80 can be done without a hitch.

In accordance with the embodiment, the staple S can be fed in the feeding direction by the components of only the magazine 40 with the pair of guides and spring receiver 75 to 77 being integrated, driving shaft 13 having a double function and staple feeding member 70 (inclusive of the feeding nail 71 and spring 74). Therefore, the staple feeding mechanism can be made simple in structure and inexpensive. Namely, in accordance with the embodiment, the component for retracting the feeding nail supposed to be necessary is not required and also the staple feeding mechanism only requires a necessary minimized number of components and so is simple in structure. Thus, the stapler can be provided at low cost.

Particularly, in accordance with the embodiment, the driving shaft 13 necessary to cause the driver link 20 to make a reciprocating motion is also used as a fulcrum member, thus requiring no new component. The configuration further reduces the number of necessary components and also contributes to space saving.

Additionally, in the embodiment, as the fulcrum member, the driving shaft 13 is employed. However, the fulcrum member according to the invention may be for example, a frame on the stapler body 11 or a separate component fixed to the frame. Further, in the embodiment, only the driver link (identical to the driver unit) is caused to make a single reciprocating motion. However, in the present invention, the clincher unit (inclusive of the case where only the clincher is driven) or both units may be driven. Further, in the embodiment, the staples wound in the roll-shape are housed in the staple cartridge. However, the present invention can be also applied to such a type of staple cartridge that a plurality of sheet stales are stacked.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A staple feeding mechanism in a stapler, the staple feeding mechanism comprising:

a driving mechanism for reciprocating at least one of a driver unit and a clincher unit from a home position before a binding operation to the same home position through a clinch completing position where clinching legs of a staple, said driver unit forming a pair of legs for each bar-like staples and driving a formed C-shaped staple by a driver, said clincher unit being opposite to said driver and including a clincher bending the legs of the staple, thereby binding sheets;

a staple feeding member arranged in said driver unit or said clincher unit moving for a stapler body, and the staple feeding member including a feeding piece feeding said staples toward a driving path of a staple cartridge;

a guide member arranged in said driver unit or said clincher unit, and guiding a feeding operation of said staple feeding member; and a fulcrum member arranged in said stapler body in a positioned state, and causing said staple feeding member to make the feeding operation in a positional relationship therewith as said driver unit or said clincher unit moves, wherein at said home position, said feeding piece is retracted from said staple cartridge by said fulcrum member and said guide member, and wherein before said driver unit or said clincher unit drives out the C-shaped staple, said staple feeding member completes the feeding operation of said staple.

2. A staple feeding mechanism in a stapler, the staple feeding mechanism comprising:

a magazine integrally forming a pair of guide members and spring receiver;

a driving shaft causing the magazine to make a reciprocating motion, and functioning as a fulcrum member; and a staple feeding member movably arranged in the magazine, the staple feeding member including a feeding nail and spring, wherein the feeding nail of the staple feeding member at a home position is lowered by the driving shaft and retracted from a staple cartridge.

* * * * *